US005351545A

United States Patent [19]

Lucas

[11] Patent Number: 5,351,545

[45] Date of Patent: Oct. 4, 1994

[54] ELECTROMAGNETIC VIBRATION GENERATORS

[75] Inventor: John H. Lucas, Essex, United Kingdom

[73] Assignee: Ling Dynamic Systems Ltd., Royston Herts, United Kingdom

[21] Appl. No.: 842,119

[22] PCT Filed: Sep. 26, 1990

[86] PCT No.: PCT/GB/90/01474

§ 371 Date: Mar. 23, 1992

§ 102(e) Date: Mar. 23, 1992

[87] PCT Pub. No.: WO91/04801

PCT Pub. Date: Apr. 18, 1991

[30] Foreign Application Priority Data

Sep. 29, 1989 [GB] United Kingdom ..... 8922054

[51] Int. Cl.[5] ..... B06B 1/00

[52] U.S. Cl. ..... 73/663

[58] Field of Search ..... 73/668, 666, 663

[56] References Cited

U.S. PATENT DOCUMENTS 3,062,041 11/1962 Spodnewski ..... 73/668

3,123,728 3/1964 Kreiskorte ..... 73/668 X 3,529,188 9/1970 Gearing .

4,715,229 12/1987 Butts ..... 73/663

FOREIGN PATENT DOCUMENTS 1125694 3/1962 Fed. Rep. of Germany .

1929703 2/1970 Fed. Rep. of Germany .

1266153 3/1972 United Kingdom .

*Primary Examiner*—Hezron E. Williams

*Assistant Examiner*—Christine K. Oda

*Attorney, Agent, or Firm*—Biebel & French

[57] ABSTRACT

An armature for an electromagnetic vibration generator is suspended at its periphery by a plurality of circumferentially spaced flexure members each connected to the vibrator stator by means of an anchoring bracket having a floating part connected to the outer end of the flexure member and a stationary part connected to the stator. The brackets are provided with recesses in each of which is located a resilient member of elongate form. The recesses have closed ends so as to reduce the tendency of the material of the resilient members to migrate during operation of the vibration generator as well as to provide rotational stiffness for the complete armature suspension assembly.

8 Claims, 3 Drawing Sheets

ELECTROMAGNETIC VIBRATION GENERATORS

BACKGROUND OF THE INVENTION

The present invention relates to electromagnetic vibration generators, sometimes known in the art as shakers, which are employed for the vibration testing of components, apparatus and equipment in numerous branches of industry and research. Such electromagnetic vibration generators basically consist of an armature which is suspended from a rigid body or stator and having a coil carried by the armature located in an air gap in the stator. A D.C. magnetic field is generated across the air gap either by permanent magnets or electromagnets and when an alternating current is fed through the armature coil, the armature is caused to vibrate along its axis at the frequency of the applied alternating current. The armature is mounted on bearings and has a plurality of peripheral suspension members disposed around it which center the armature in the air gap and allow free movement along its axis of vibration but which impose a high stiffness to any lateral movement of the armature normal to its axis of vibration. An article to be vibration tested may be placed directly on top of the armature or on a work table carried by the armature when the vibration testing is to be carried out in the vertical mode, or the article to be tested may be placed on a horizontal slip table coupled to the armature when the vibration testing is to be carried out in the horizontal mode, as is well known in the art.

In one known vibration generator the peripheral suspension members each consist of a flexure member in the form of one or more leaves of polypropylene which are rigidly connected at one end to the armature and anchored at the other end to the stator via a U-shaped bracket. Although such a flexible suspension structure has been found to be adequate when the vibrational stroke of the armature is within certain limits which have hitherto been accepted by users; there is now a requirement for a longer vibrational stroke of the armature. As a result, premature failure of the bracket can occur due to fatigue since it cannot sustain the increased flexing load imposed upon it by the larger vibrational stroke of the armature.

SUMMARY OF THE INVENTION

According to the present invention, there is provided an electromagnetic vibration generator having an armature suspended from a stator, in which the armature for transmitting the vibrations generated to an article to be vibrated is suspended at its periphery by a plurality of circumferentially spaced flexure members each connected at their outer end to the stator by means of an anchoring bracket comprising a floating part connected to the outer end of the flexure member, a stationary part connected to the stator and at least one resilient member disposed between and located with respect to said parts, characterised in that the parts of the bracket are provided with recesses in each of which is located a part of a resilient member of elongate form and the recesses are blind, that is to say have closed ends, so as to reduce the tendency of the material of the resilient member or members to migrate during operation of the vibration generator as well as to provide rotational stiffness for the complete armature suspension assembly.

The resilience of the bracket is such that it can withstand foreshortening of the flexure member as it flexes during movement of the armature along its axis of vibration whilst providing stiffness in the direction of torsional movement of the armature about the said axis.

Preferably each bracket comprises a central rigid floating part disposed between two outer rigid stationary parts and at least one resilient member is arranged between either side of the floating part and the adjacent stationary part.

In one embodiment, each bracket comprises four elongate resilient members arranged two on either side of the central floating part, each resilient member being located by a blind recess in the floating part and a blind recess in the adjacent rigid part. Each bracket is connected to the flexure member such that the lengths of the resilient members extend in the peripheral direction of the stator, that is to say generally along the direction of torsional movement of the armature.

In a preferred embodiment, the resilient members are cylindrical or sausage-shaped, and the blind recesses have a semi-circular cross-section. The resilient members may advantageously be made of natural rubber of 60/80 shore strength, although other resilient rubber-like materials may be used.

The flexure members connected between the armature and each bracket advantageously consist of a plurality of superposed leaves of a suitable tough material which is capable of withstanding repeated flexing, such as polypropylene. The bracket parts are preferably made of a metal such as steel or an aluminium alloy.

BRIEF DESCRIPTION OF THE DRAWINGS

The invention will now be further described, by way of example, with reference to the accompanying drawings, in which.

DESCRIPTION OF THE PREFERRED EMBODIMENT

Figure 1:
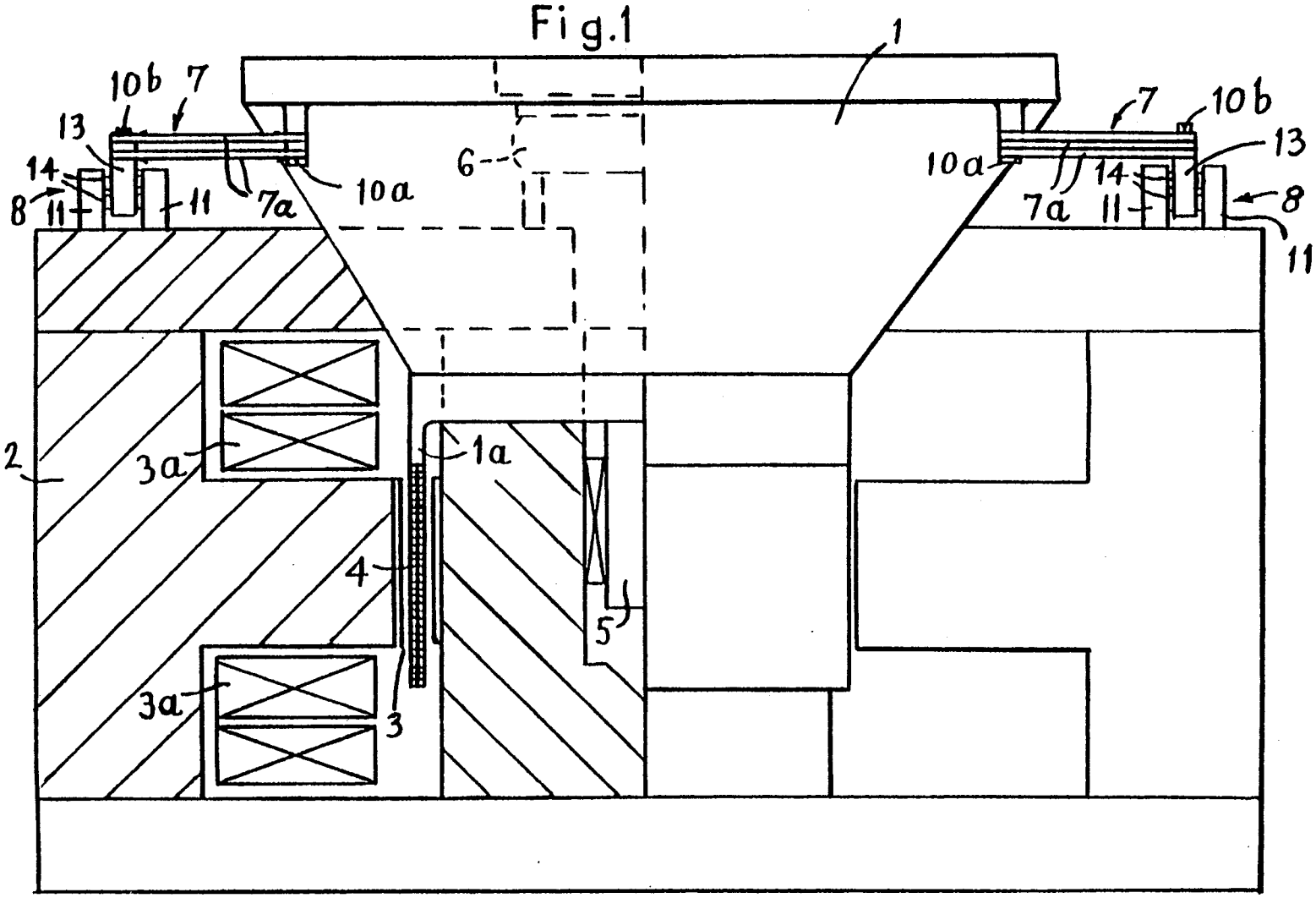
FIG. 1 is a side elevation, partly in section, of one embodiment of electromagnetic vibration generator according to the invention.

Referring to the drawings, the electromagnetic vibration generator illustrated comprises an armature 1 mounted for vibratory movement relative to a rigid stator or body 2. The latter is provided with trunnions (not shown) by which may be supported in a rigid frame so that the vibration generator can be oriented either for vibration along a vertical axis or along a horizontal axis. As seen in FIG. 1, the body is provided with an annular air gap 3 across which is produced a D.C. magnetic field generated by electromagnets 3*a*, and within which is located a coil 4 attached to the lower end 1*a* of the armature structure. As is well known in the art, energisation of the armature coil 4 by an alternating current causes the armature 1 to vibrate relative to the body 2, along its longitudinal axis at the frequency of the alternating current applied to the coil 4. The armature 1 is mounted on an axially located bearing 5, for example a hydrostatic bearing or recirculating ball bushing, which allows free movement of the armature along its vibratory axis but which restrains lateral movement of the armature. In this embodiment the armature is also supported by an air bag 6.

The periphery of the armature 1 is suspended from the body 2 by flexure members 7 each of which has an outer end connected to anchoring brackets 8 mounted on the body 2. This arrangement serves to center the armature coil 4 in the air gap 3 and also allows free movement of the armature along its axis of vibration but imparts a high stiffness to any lateral movement of the armature. In this embodiment four such flexure members are disposed equiangularly about the periphery of the armature.

Figure 2:
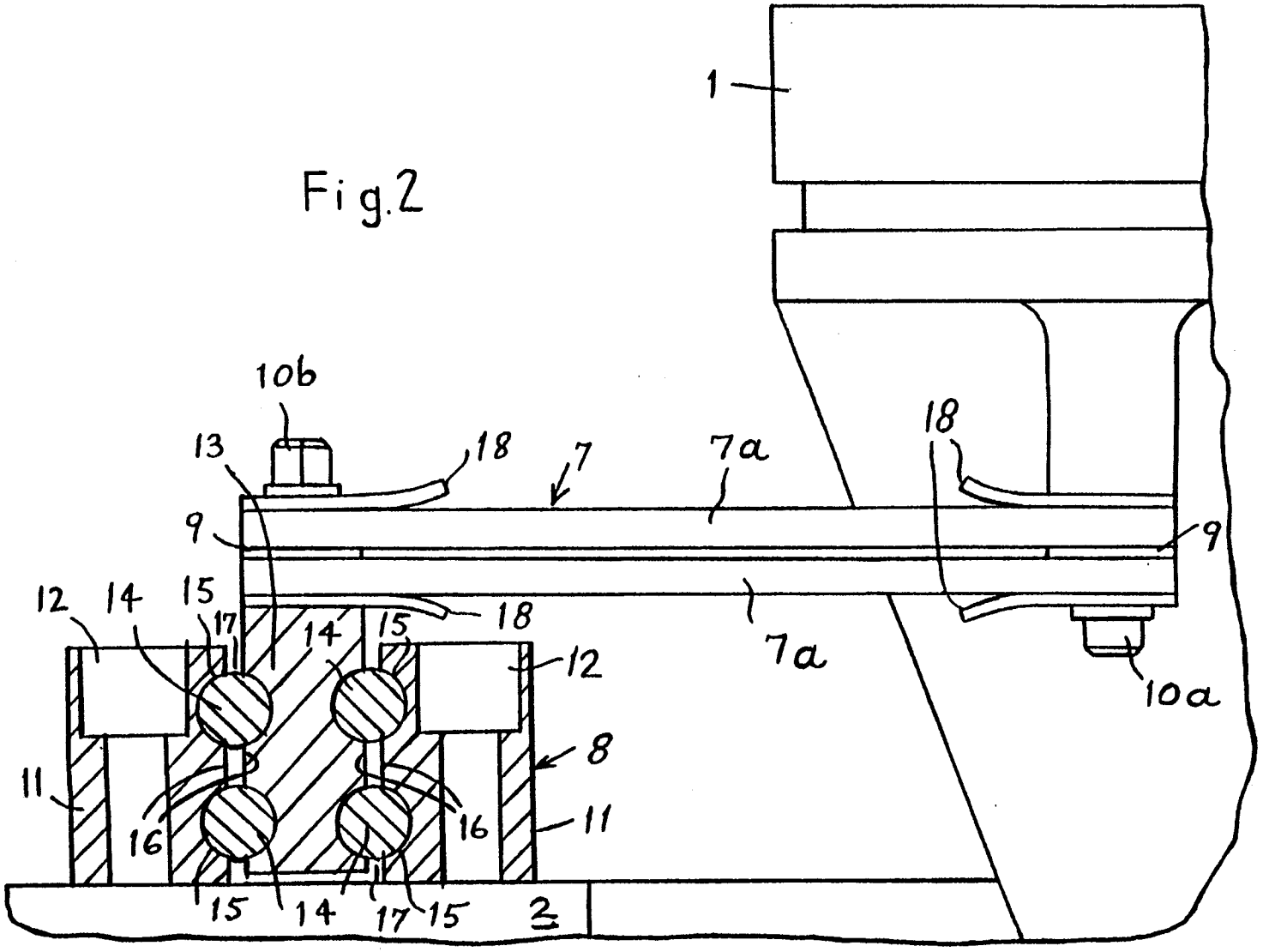
FIG. 2 is a side elevation, partly in section and to a larger scale, of one of the flexible suspension structures for the armature of the vibration generator of FIG. 1.
Figure 3:
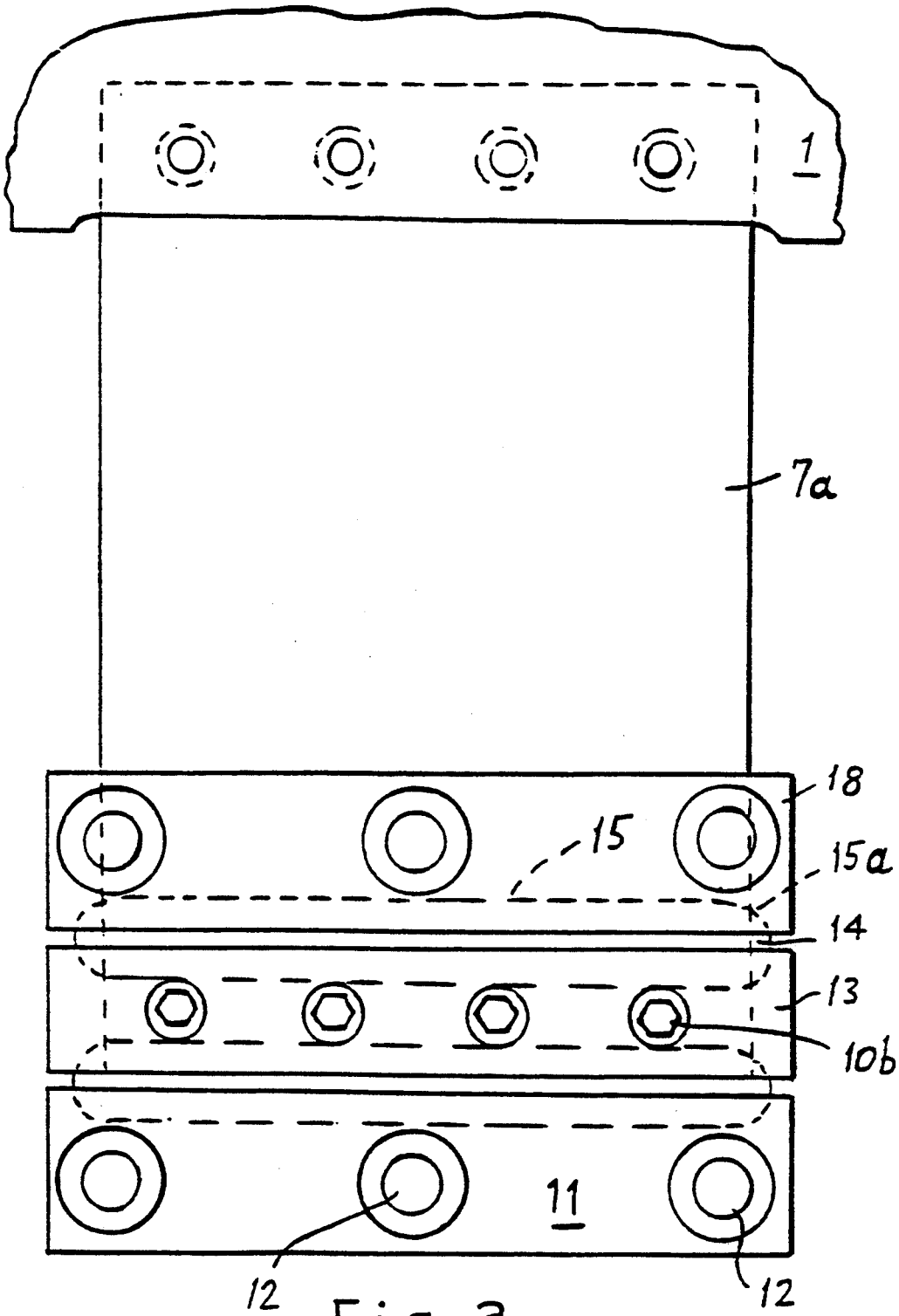
FIG. 3 is a plan view of the structure shown in FIG. 2.

As best seen in FIGS. 2 and 3, each flexure member 7 comprises a pair of superposed leaves 7*a* of polypropylene which are of generally rectangular shape and spaced apart by spacers 9 so as to leave a small gap between the leaves. The inner and outer ends of the leaves are respectively secured to the armature 1 and the associated bracket 8 by means of bolts 10*a* 10*b*.

Each of the anchoring brackets consists of two spaced rigid outer support blocks 11 connected to the body 2 by bolts 12 and a floating intermediate part 13 connected to the outer end of the flexure member 7 by the bolts 10*b*. Four elongate cylindrical resilient members 14 are arranged parallel to each other, two on each side of the floating intermediate blocks 13 and one above the other, and they are retained within blind recesses 15 of part-circular cross-section formed in the facing surfaces of the three support blocks 11,11,13. The two outer support blocks 11 are each separated from the central support block 13 by a gap 17, such that the resilience of the members 14 allows the central block 13 to float between the outer blocks as the armature vibrates and thus to permit adequate flexing of the flexure members 7 over the whole range of the armatures vibrational stroke without the risk of fatigue fractures occurring. Curved metal plates 18 located on either side of the flexure member 7 serve to restrain the overall flexing movement adjacent each end of the flexure member 7. As can be seen, the structures are so arranged that the lengths of the resilient members 14 are disposed substantially in the peripheral direction of the stator and since they are restrained by the closed ends 15*a* of the recesses 15, they tend to provide torsional stiffness restraining movement of the armature about its axis of vibration.

During vibrational movement of the armature, the flexure members assume an oscillating generally "S" shape which foreshortens the flexure member by an amount depending on the amplitude of the vibrational stroke. This foreshortening of the flexure member causes compressive forces to be applied to the resilient members which are thus able to absorb this load without causing undue fatigue of the bracket.

By means of the structure described it has been possible to increase the working stroke of the armature of one embodiment of vibration generator from 1 inch (2.5 cm) to 2 inch (5 cm) without any fatigue failure of the bracket.

Whilst a particular embodiment of the present invention has been described, various modifications will be envisaged without departure from the scope of the invention. For example, although the vibration generator has been described with four flexure members and associated anchoring brackets arranged equiangularly around the periphery of the stator, any other practical number of such flexure members and anchoring brackets may in fact be provided. Moreover, the precise construction of the flexure members and the number and material of the leaves may be different from that shown. The structure of the bracket assembly may also be varied considerably within the scope of the invention. For example the number and shape of the resilient members may be other than described. Also each bracket may comprise only a floating part and one stationary part if the resilient member or members disposed between them are bonded to the parts.

I claim:

1. In an electromagnetic vibration generator comprising a stator, a coil-driven armature suspended within said stator for transmitting vibrations to an article to be vibrated, and suspension means bridging said armature and said stator for suspending said armature as aforesaid; the improvement wherein said suspension means comprises:

a plurality of peripherally spaced flexure members, each having an inner end and an outer end;

means securing each said inner end to said armature; and a plurality of brackets equal in number to the number of said flexure members, each of said brackets supporting the outer end of an associated one of said flexure members and each comprising:

two spaced outer rigid stationary parts; a central rigid floating part sandwiched between said stationary parts; and a pair of resilient members disposed on opposite sides of said floating part between said floating part and said stationary parts;

mutually facing blind recesses being formed in said floating part and in said stationary parts for receiving and locating said resilient members, thereby reducing the tendency of said resilient members to migrate during operation of said vibration generator and providing rotational stiffness for said armature.

2. The vibration generator of claim 1, each of said brackets comprising two pairs of said resilient members; said mutually facing blind recesses being formed as aforesaid for receiving and locating all of said resilient members.

3. The vibration generator of claim 1 wherein said resilient members have a generally cylindrical configuration.

4. The vibration generator of claim 1 wherein said resilient members are elongated and are oriented so as to extend in a direction which is generally peripheral of said stator.

5. The vibration generator of claim 1, wherein said resilient members are made of natural rubber of 60/80 shore strength.

6. The vibration generator of claim 1, wherein each of said flexure members each comprises a plurality of superposed leaves.

7. The vibration generator of claim 6, wherein each of said flexure members further comprise spacers inserted between, and separating adjacent ones of said leaves so as to leave a gap therebetween.

8. The vibration generator of claim 1, wherein said suspension means comprises four of said flexure members, circumferentially spaced in an equiangular arrangement, each of said flexure members having an inner end secured as aforesaid and an outer end supported as aforesaid.

* * * * *